US008232493B2

(12) United States Patent
Ichikawa et al.

(10) Patent No.: US 8,232,493 B2
(45) Date of Patent: Jul. 31, 2012

(54) OPERATING DEVICE

(75) Inventors: Yuichi Ichikawa, Tokyo (JP); Akiko Ogata, Tokyo (JP)

(73) Assignee: Pentax Ricoh Imaging Company, Ltd., Tokyo (JP)

( * ) Notice: Subject to any disclaimer, the term of this patent is extended or adjusted under 35 U.S.C. 154(b) by 996 days.

(21) Appl. No.: 12/164,416

(22) Filed: Jun. 30, 2008

(65) Prior Publication Data

US 2009/0020402 A1 Jan. 22, 2009

(30) Foreign Application Priority Data

Jul. 2, 2007 (JP) ..... 2007-173808
Jul. 2, 2007 (JP) ..... 2007-174414

(51) Int. Cl.
*H01H 3/12* (2006.01)

(52) U.S. Cl. ..... 200/341; 200/302.2

(58) Field of Classification Search ..... 200/314, 200/341, 302.1–302.3
See application file for complete search history.

(56) References Cited

U.S. PATENT DOCUMENTS 2,954,452 A * 9/1960 Neumann ..... 200/302.3
3,472,983 A * 10/1969 Lyons et al. ..... 200/559
3,952,174 A * 4/1976 Boulanger et al. ..... 200/5 A
3,973,099 A * 8/1976 Morris, Sr. ..... 200/511
4,074,088 A * 2/1978 Keough et al. ..... 200/5 A
4,170,104 A * 10/1979 Yamagata ..... 368/289
4,302,637 A * 11/1981 Ditzig ..... 200/6 R
5,258,592 A * 11/1993 Nishikawa et al. ..... 200/302.2
5,471,022 A * 11/1995 Kiss et al. ..... 200/83 B
6,878,893 B2 * 4/2005 Tanaka et al. ..... 200/406
7,230,195 B2 * 6/2007 Ohnishi ..... 200/302.1
7,705,255 B2 * 4/2010 Yokote ..... 200/302.2
8,023,240 B2 * 9/2011 Ichikawa et al. ..... 361/115

FOREIGN PATENT DOCUMENTS

JP 7-295052 A 11/1995
JP 2002-231091 8/2002
JP 2005-251551 A 9/2005
JP 2007-59346 3/2007

OTHER PUBLICATIONS

English language Abstract and machine translation of JP 7-295052 A.
English language Abstract and machine translation of JP 2005-251551 A.
U.S. Appl. No. 12/169,055 to Ichikawa et al., which was filed on Jul. 8, 2008.
Japan Office action, dated Jan. 10, 2012 along with an english translation thereof.

* cited by examiner

*Primary Examiner* — Elvin G Enad
*Assistant Examiner* — Lisa Homza
(74) *Attorney, Agent, or Firm* — Greenblum & Bernstein, P.LC.

(57) ABSTRACT

An operating device is provided having a supporting member, a button, an elastic member, and a bearing member. The supporting member has an opening which passes through the thickness direction of the supporting member. The button has a shaft and an engaging portion. The shaft is arranged such that the axial direction of the shaft is parallel to the thickness direction of the supporting member. The engaging portion projects parallel to the axial direction of the shaft. The elastic member is set onto the supporting member so as to cover the opening, and has a projecting portion which engages the end of the shaft. The bearing member is provided between the supporting member and the elastic member, which is provided around the opening and is located nearer to the shaft than the engaging portion in the direction orthogonal to the projecting direction of the shaft. The shaft may press the elastic member so that the elastic member is deformed so as to move along the thickness direction of the supporting member in the opening.

17 Claims, 8 Drawing Sheets

OPERATING DEVICE

BACKGROUND OP THE INVENTION

1. Field of the Invention

The present invention relates to an operating device, such as one which may be used in a portable device.

2. Description of the Related Art

Conventionally, an operating device comprises a button which may be pushed by the user, an elastic member which supports the button, and a supporting member which supports the elastic member. The operating device is used as input equipment, such as a release button, to operate a device such as a camera. The elastic member is provided between the button and the push switch. When the user pushes the button, the button pushes the elastic member, and the elastic member pushes a push switch which is provided in the camera. The supporting member has an opening. The elastic member biases the button towards the exterior of the camera so that a part of the button projects from the opening. The outer periphery of the button is freely fitted with the inner periphery of the opening.

Such an operating device may be used as a shutter release button in a waterproof camera as a waterproof operating device. When the waterproof operating device is pressed, a push switch provided in the waterproof camera is pushed by a shaft extending from the waterproof operating device into the waterproof camera. An elastic member is provided between the waterproof operating device and the push switch, opposing pressure applied by the shaft, and preventing intrusion of water into the waterproof camera.

The waterproof operating device opposes water pressure with the elasticity of the elastic member to prevent the push switch from being pushed by the shaft which is itself pushed by water pressure. Operability of the waterproof operating device may be more difficult in this case, because the elastic member would require stiffness to counter the water pressure. To improve the operability, the elastic member is supported by the supporting member with providing space around the shaft. The elastic member is stretched in space, so that the stiffness of the elastic member is relieved.

In the operating device, when the outer periphery of the button is freely fitted with the inner periphery of the opening, the button may wobble in the opening, making the button uncomfortable to use.

In the case of the waterproof operating device, its operability might not be improved by providing space around the shaft, because at atmospheric pressure, the user must push the waterproof operating device strongly against stiffness of the elastic member, while under the water, the user would need to push it delicately because of the water pressure contribution to the user's push.

SUMMARY OF THE INVENTION

An object of the present invention is to provide an operating device which provides good tactile response during operation.

According to the present invention, there is provided an operating device which has a button, a supporting member, an elastic member, and a bearing member. The supporting member has an opening which passes through the thickness direction of the supporting member. The button has a shaft and an engaging portion. The shaft is arranged such that the axial direction of the shaft is parallel to the thickness direction of the supporting member. The engaging portion projects parallel to the axial direction of the shaft. The elastic member is set onto the supporting member so as to cover the opening, and has a projecting portion which engages the end of the shaft. The bearing member is provided between the supporting member and the elastic member, which is provided around the opening and is located nearer to the shaft than the engaging portion in the direction orthogonal to the projecting direction of the shaft. The shaft may press the elastic member so that the elastic member is deformed so as to move along the thickness direction of the supporting member in the opening.

BRIEF DESCRIPTION OF THE DRAWINGS

The objects and advantages of the present invention will be better understood from the following description, with reference to the accompanying drawings in which:

FIG. 4 is a cross-sectional view along the III-III line of FIG. 1, showing the operating device pushed in;

FIG. 6 is a cross-sectional view along the III-III line of FIG. 1 showing the operating device pushed in;

DESCRIPTION OF THE PREFERRED EMBODIMENTS

Figure 1:
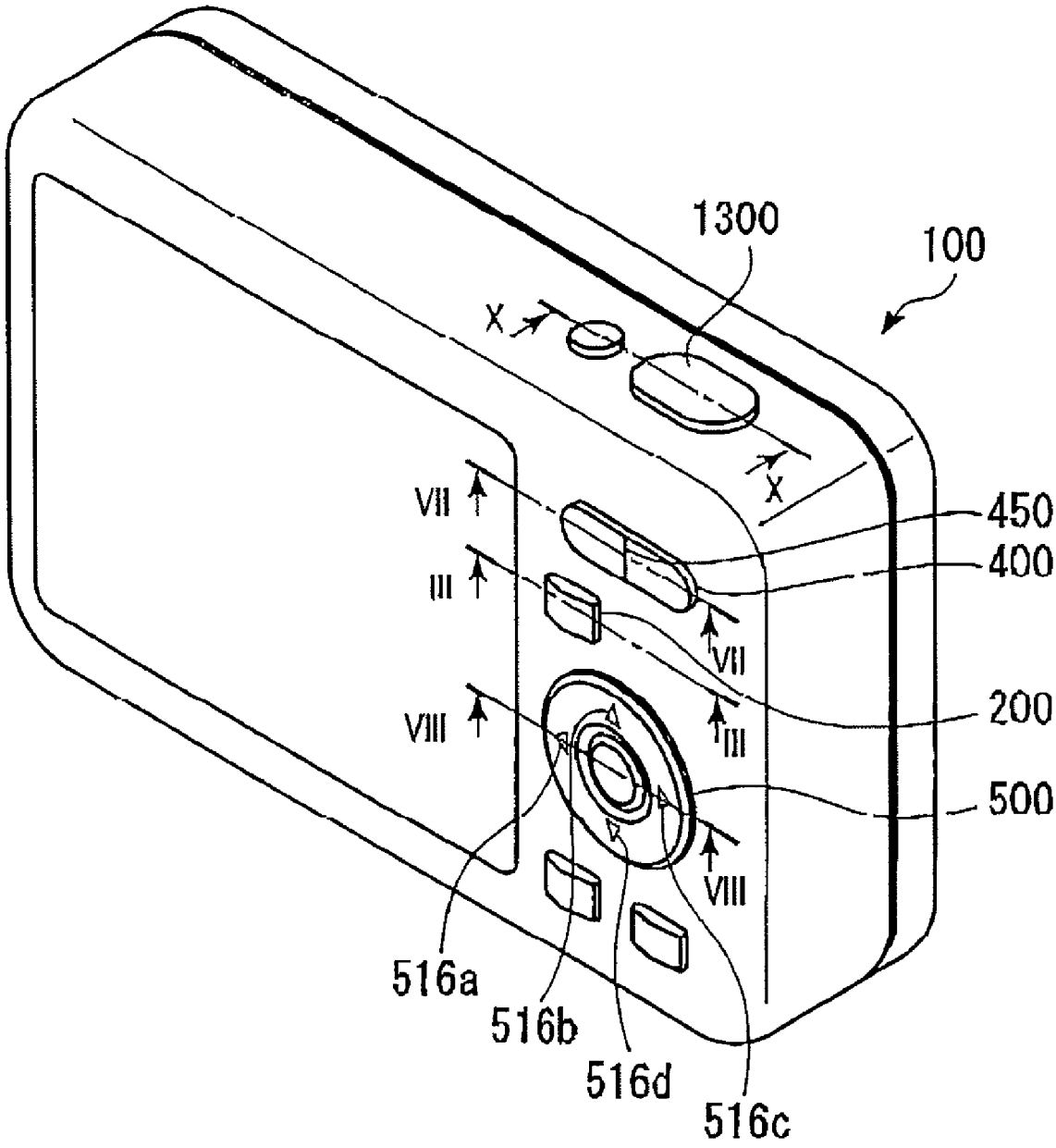
FIG. 1 is a plan view showing a camera provided with the operating device in an embodiment of the present invention.
Figure 2:
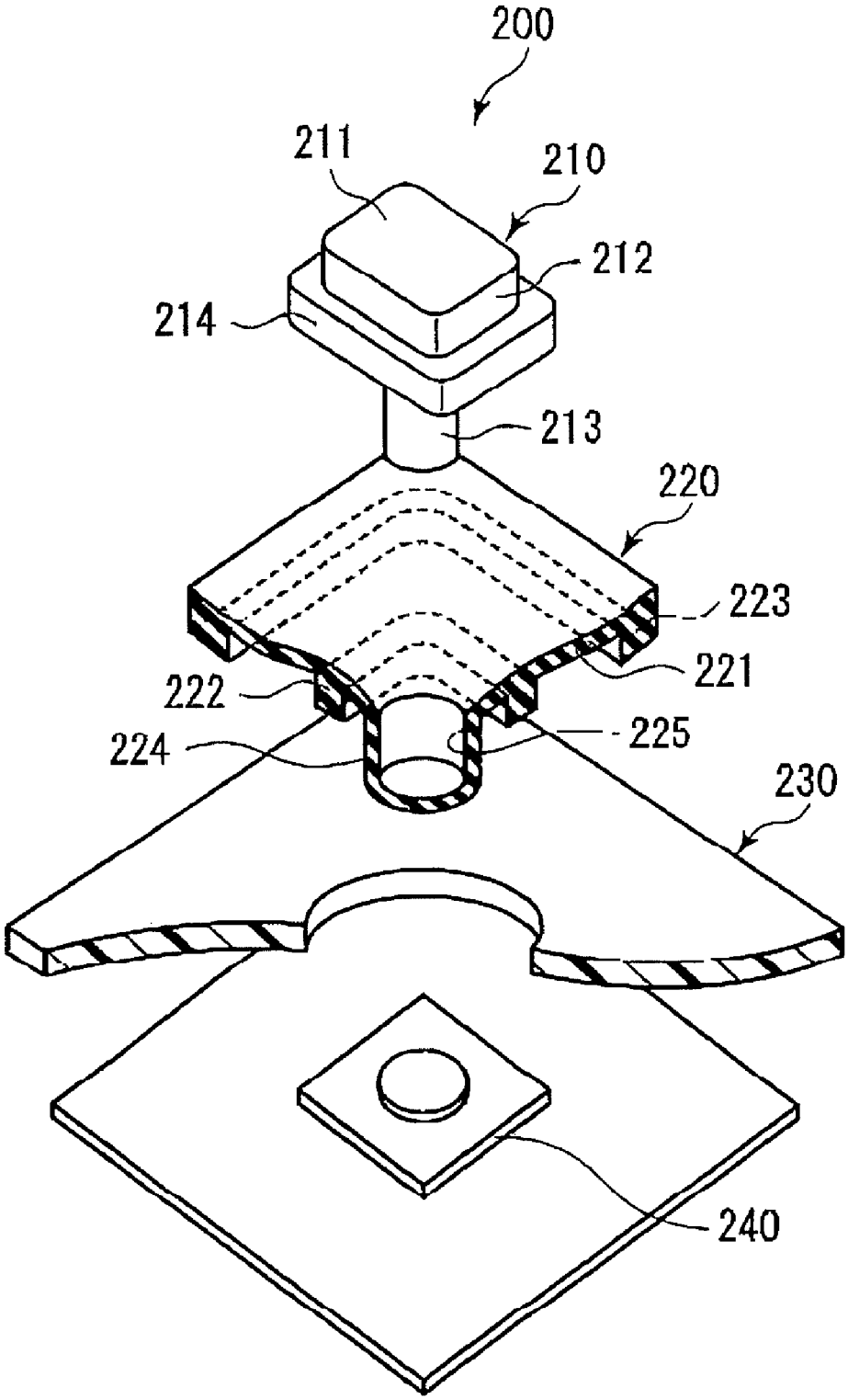
FIG. 2 is a cross-sectional exploded view showing the operating device.
Figure 3:
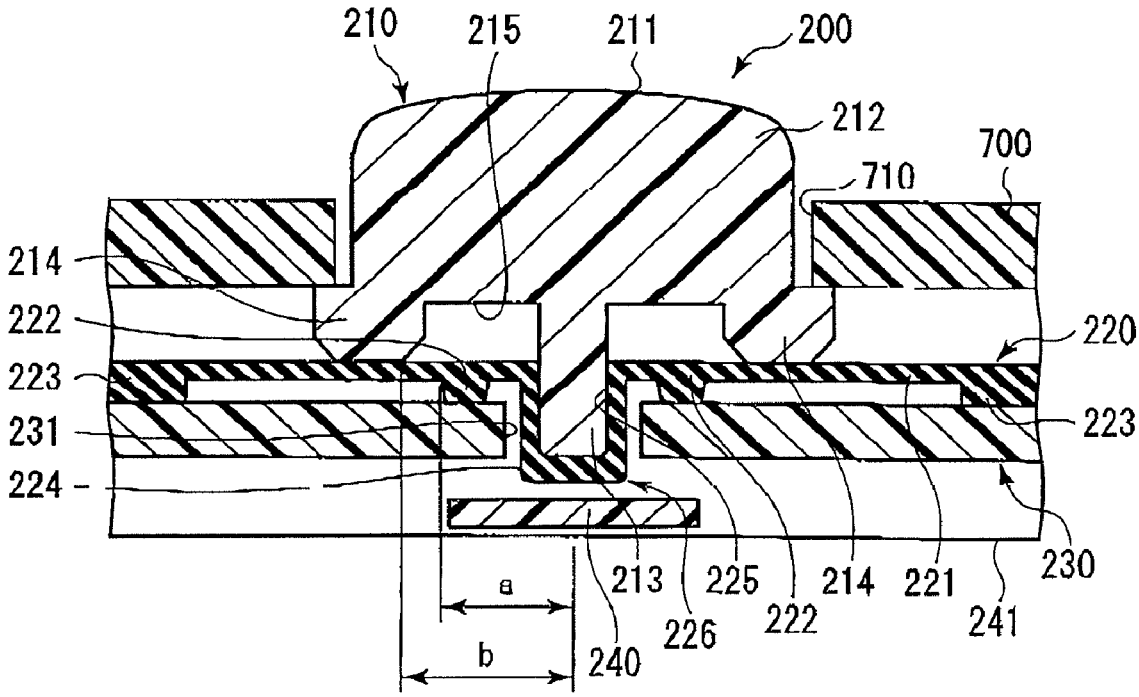
FIG. 3 is a cross-sectional view showing the operating device in the III-III line of FIG. 1.

The present invention is described below with reference to the embodiments shown in the drawings.

The first embodiment of the operating device is described below with reference to FIGS. 1 to 4.

An operating device 200 is provided on the back of the camera 100, and is used for operating the camera 100. A top surface of the operating device 200 protrudes from the exterior surface of the camera 100. The user pushes it to operate the camera 100.

The operating device 200 comprises the button 210 which protrudes from the exterior part of the camera 100 so that users may push it, an elastic member 220 which is provided in the camera 100 to support the button 210, and a supporting member 230 which is provided further inward towards the camera 100 than the elastic member 220 so that it supports the elastic member 220.

The button 210 comprises a pushed member 212 having a top surface 211 which protrudes from the exterior part of the camera 100, a button shaft 213 which projects towards the inside of the camera 100 from a bottom surface 215 which is back side of the top surface 211, and an engaging portion 214 which contacts the elastic member 220. The pushed member 212 is an approximately rectangular solid with rounded corners. The engaging portion 214 projects from the bottom surface 215 in the direction of the elastic member 220, and projects from the outer periphery of the pushed member 212 to form a flange. The side surface of the pushed member 212 is freely engaged with the inner surface of the hole 710 in the exterior part 700. The surface of the flange 214 may engage with the end of the hole 710 so as to limit the extent of protrusion of the member 212 from the outer surface of the exterior part 700.

The elastic member 220 has a base 221 in the form of a plate. A projecting portion 226 is formed in the center of the base 221. The outer surface of the end of the button shaft 213 fits onto the inner surface of the projecting portion 226. The button shaft 213 pushes the projecting portion 226 so that the projecting portion 226 undergoes elastic deformation and moves with the button shaft 213 as a unit. The inner surface of the projecting portion 226 is the dent portion 225 which is formed in the center of the surface facing the button 210. The outer surface of the projecting portion 226 is the convex portion 224 which projects from the back surface of the dent portion 225. Around the convex portion 224, the bearing member i.e. the support rib 222 projects from the surface facing the supporting member 230. It has a rectangular shape in the cross section. The outer rib 223 is provided on the outer edge of the base 221. The elastic member 220 is supported by the supporting member 230 which contacts the support rib (bearing member) 222 and the outer rib (bearing member) 223 of the elastic member 220.

The opening 231 is provided in the supporting member 230. The elastic member 220 is provided on the surface of the supporting member 230 facing the exterior part 700 so that the projecting portion 226 loosely fits the opening 231. The support rib 222 contacts the supporting member 230 around the opening 231. The outer rib 223 and the supporting member 230 are bonded together by ultrasonic welding or by adhesive.

The push switch 240 is provided in the camera 100 facing the leading edge of the convex portion 224. The push switch 240 is soldered on the substrate 241.

The support rib 222 does not overlap the engaging portion 214 from the view of the pushing direction of button 210. In other words, the distance b between the center of the axle of the button shaft 213 and the inner surface of the engaging portion 214 is greater than the distance a between the center of the axle of the button shaft 213 and the outer surface of the support rib 222. The engaging portion 214 is not directly forced by the elastic force of the support rib 222 when the button 210 is pushed. Therefore, the invention prevents wobble of the button 210 and reduces the reaction force against the pushing force.

The corners of the engaging portion 214 and the support rib 222, which contact the elastic member 220, are chamfered. This chamfering reduces the reaction force against the pushing force, because the deformation volume of the elastic member 220 around the engaging portion 214 and the support rib 222 is reduced when the button 210 is pushed down. Moreover, the operating life of the elastic member 220 is improved because the elastic member 220 does not deform more than required.

Figure 4:
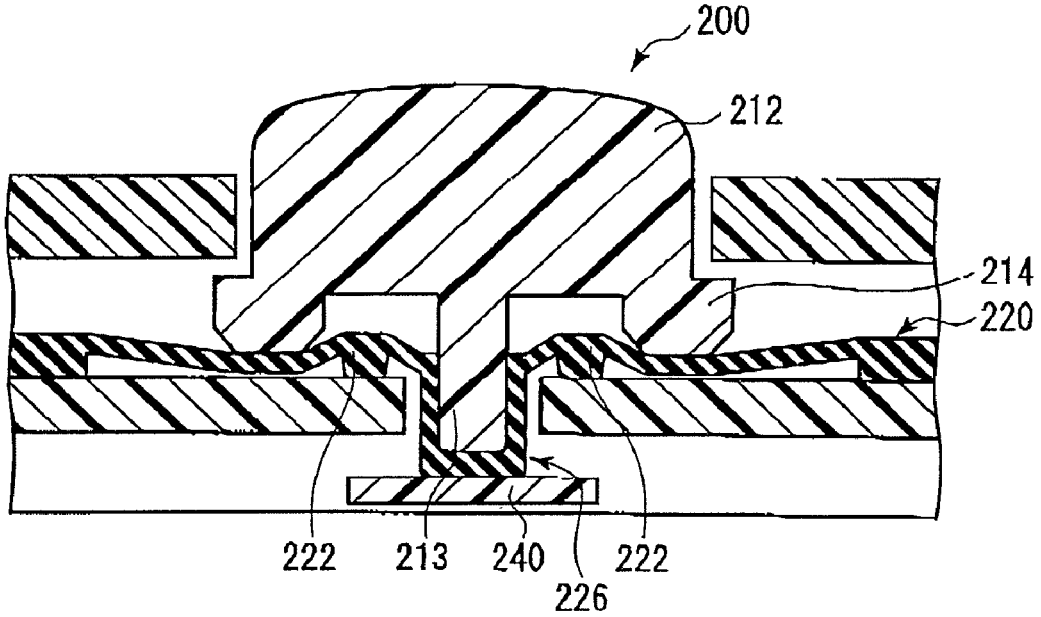

The operating device 200 is described below with reference to FIG. 4 for the case that button 210 is pushed down. As button 210 is pushed down, the engaging portion 214 pushes the elastic member 220. At this time, the engaging portion 214 pushes down the outside of the elastic member 220 rather than the support rib 222. The button shaft 213 is pushed down toward the push switch 240 together with the elastic member 220, and then pushes on the push switch 240.

In the embodiment, button 210 does not wobble, and the reaction force against the pushing force is reduced, resulting in an operating device with a good tactile response during operation.

Figure 5:
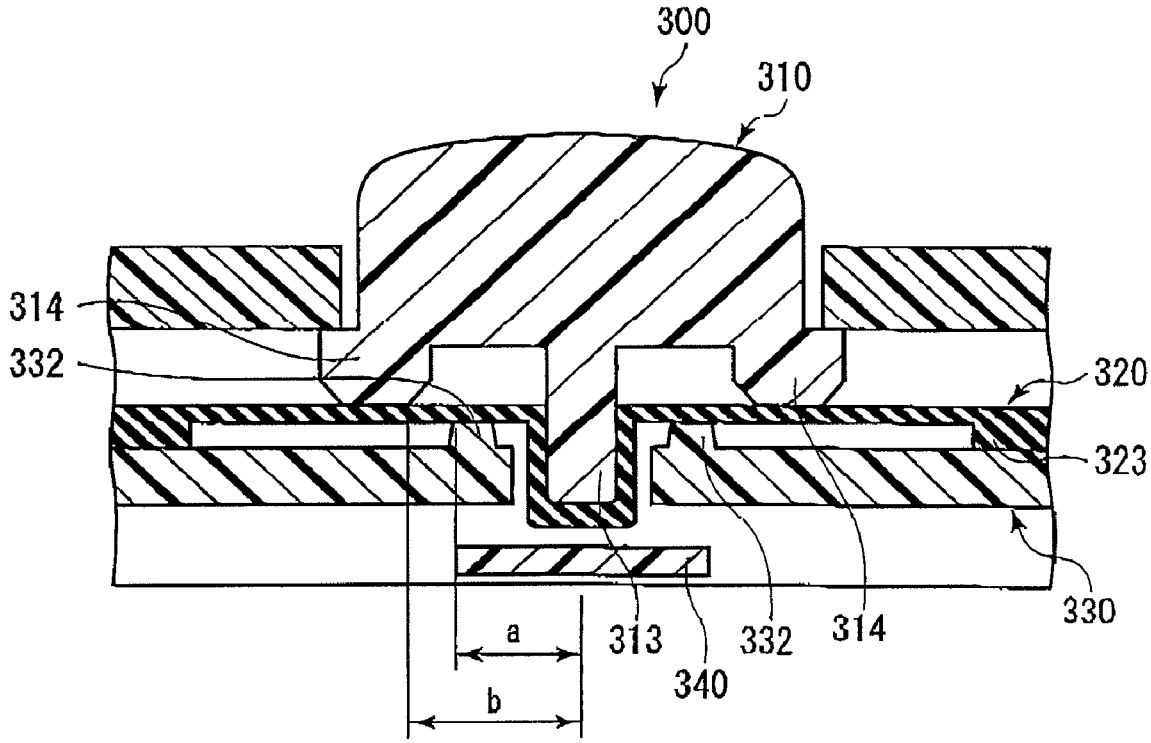
FIG. 5 is cross-sectional view showing the operating device along the III-III line of FIG. 1 as another embodiment of the present invention.
Figure 6:
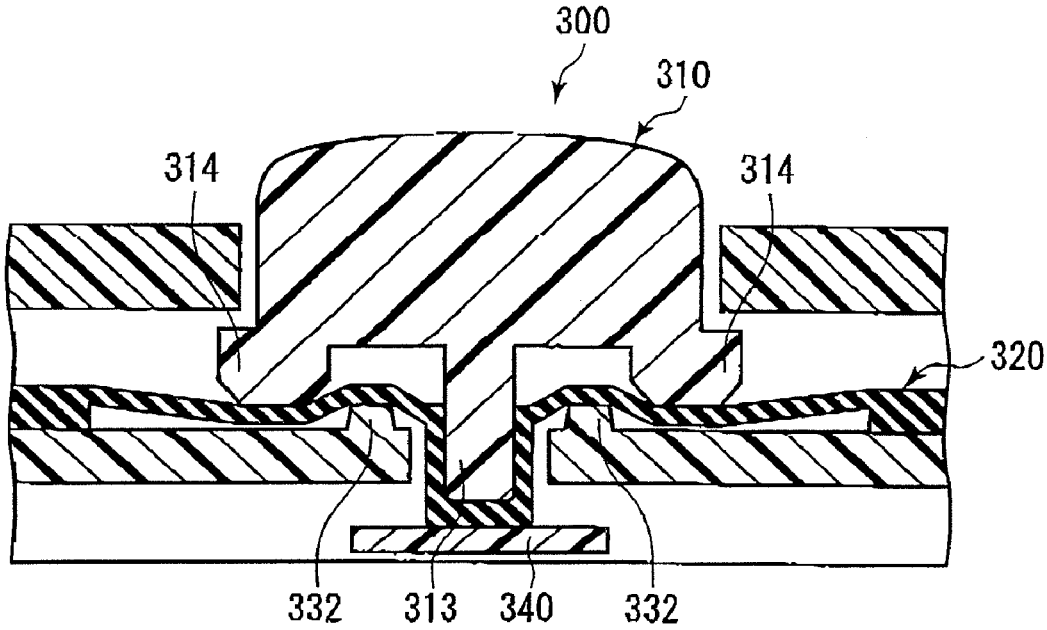

The second embodiment of the operating device is described below with reference to FIGS. 5 and 6. Descriptions of constructions similar to those of the embodiment described above are omitted.

In this embodiment, the elastic member 320 is supported by the support rib (bearing member) 332 which projects from the supporting member 330 and the outer rib (bearing member) 323 which is provided in the elastic member 320. The support rib 332 does not overlap with the engaging portion 314 from the view of the pushing direction of button 310. In other words, the distance h between the center of the axle of the button shaft 313 and the inner surface of the engaging portion 314 is greater than the distance a between the center of the axle of the button shaft 313 and the outer surface of the support rib 332.

The engaging portion 314 is not directly forced by the elastic force of the support rib 332 when the button 310 is pushed. Therefore, the invention prevents wobble of the button 310 and reduces the reaction force against the pushing force.

The corners of the engaging portion 314 and the support rib 332, which contact the elastic member 320, are chamfered. This chamfering reduces reaction force against the pushing force, because the deformation volume of the elastic member 320 around the engaging portion 314 and the support rib 332 is reduced when the button 310 is pushed down. Moreover, the operating life of the elastic member 320 is improved because the elastic member 320 does not deform more than required.

The operating device 300 is described below with reference to FIG. 6 for the case that button 310 is pushed down. As button 310 is pushed down, the engaging portion 314 pushes the elastic member 320. At this time, the engaging portion 314 pushes down the outside of the elastic member 320 rather than the support rib 322. The button shaft 313 is pushed down toward the push switch 340 together with the elastic member 320, and then pushes on the push switch 340.

According to the embodiment, the button 310 does not wobble, and the reaction force against the pushing force is reduced, resulting in an operating device with good tactile response during operation.

Figure 7:
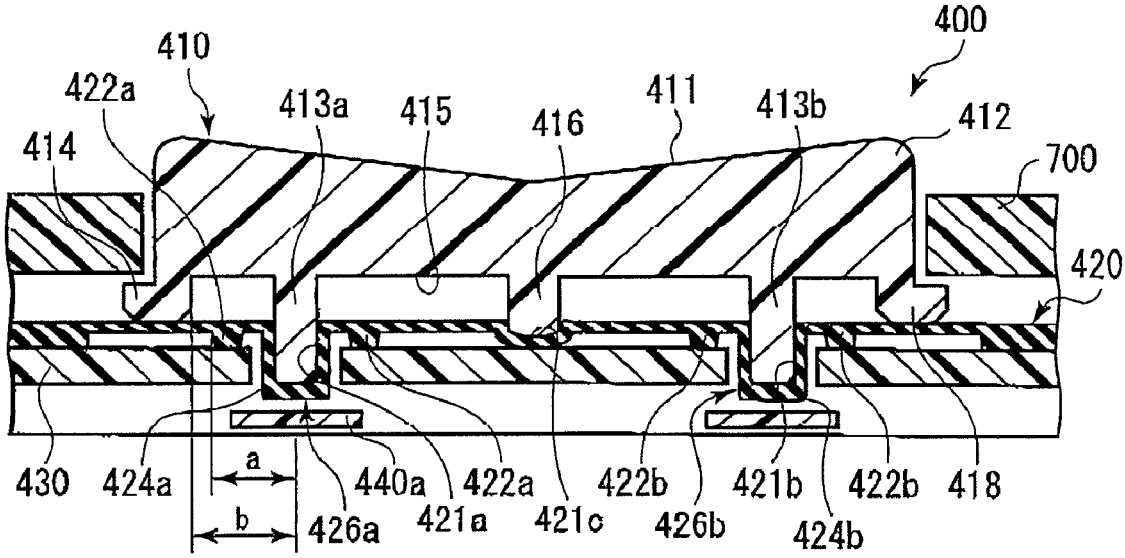
FIG. 7 is cross-sectional view along the VII-VII line of FIG. 1 showing the operating device in another embodiment of the present invention.
Figure 8:
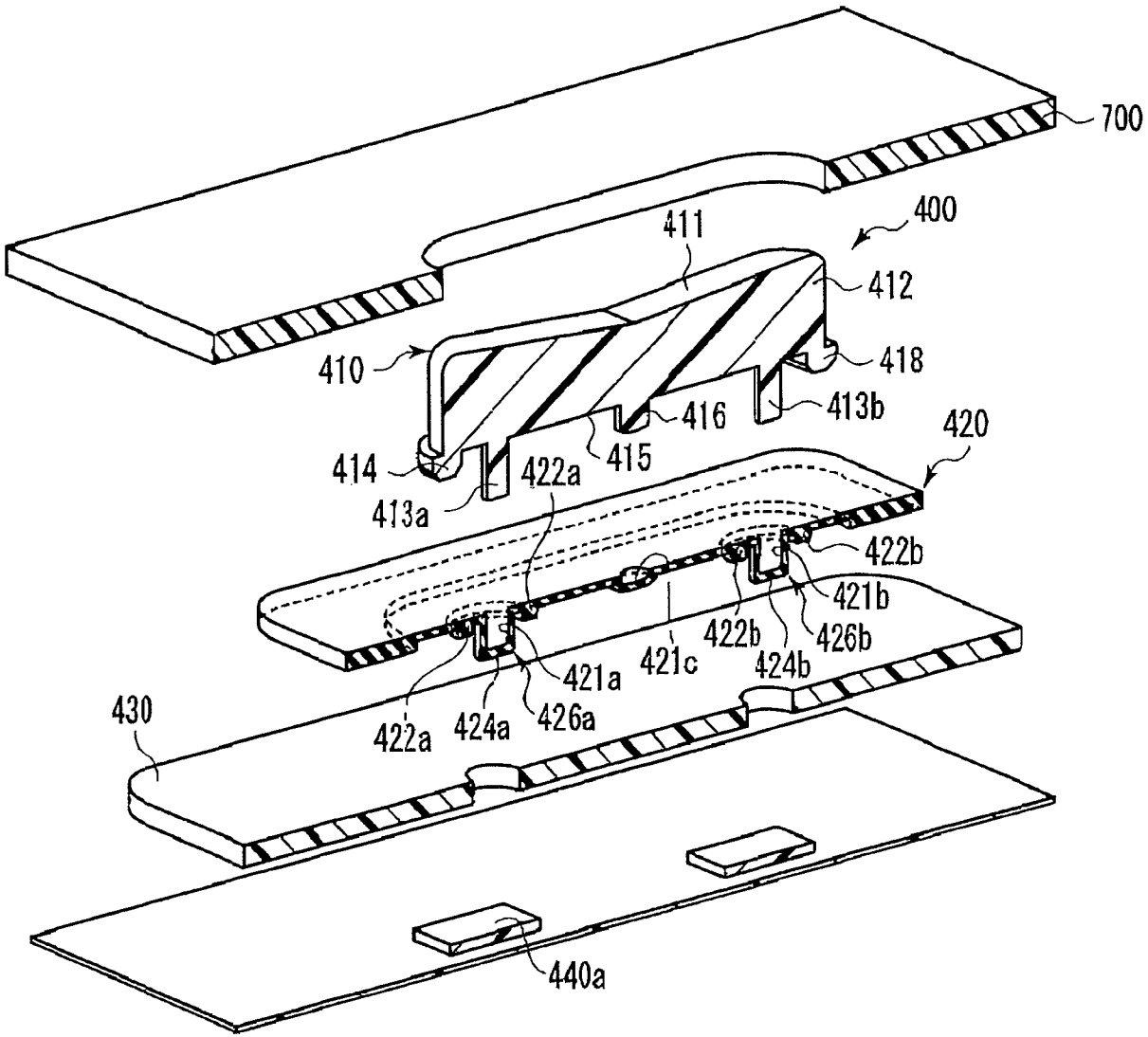
FIG. 8 is a cross-sectional exploded view showing the operating device along the VII-VII line of FIG. 1.

The third embodiment of the operating device is described below with reference to FIGS. 1, 7, and 8. Descriptions of the constructions similar to those of the first embodiment are omitted.

The button 410 projects the approximately rectangular top surface 411 from the exterior surface of the camera, and swings on the fulcrum member 416 which is provided on the back surface 415 of the top surface 411.

In the lengthwise direction, the top surface 411 rises from the center to the end. This shape enables the user to easily push the end of the top surface 411.

The first button shaft 413*a* and the second button shaft 413*b* are provided in the button 410 so that they lie symmetrical to each other with respect to the surface passing through the fulcrum member 416 and extending in the width direction of the button 410 (the line 450). The first engaging portion 414 is provided on the swinging end of the button 410 situated next to the first button shaft 413*a*. The second engaging portion 418 is provided on the swinging end of the button 410 situated next to the second button shaft 413*b*. The first and second engaging portions 414 and 418 project from the pushing member 412 toward the elastic member 420, and project from the circumference surface of the pushing member 412 in the radial direction.

The elastic member 420 is attached on the bottom surface of the button 410. The bottom surface is the back side of the top surface 411. The elastic member 420 comprises the first, second, and third dent portions 421*a*, 421*b*, and 421*c* which engage respectively with the first button shaft 413*a*, the second button shaft 413*b*, and the fulcrum member 416. The first and second dent portions 421*a* and 421*b* project from the bottom surface of the elastic member 420 and form the first and second convex portions 424*a* and 424*b*. That is, the projecting portions 426*a* and 426*b* cover the end of the first and second button shafts 413*a* and 413*b*, respectively. The first convex portion 424*a* fitting with the first button shaft 413*a* is surrounded by the first support rib (bearing member) 422*a*. The second convex portion 424*b* fitting with the second button shaft 413*b* is surrounded by the second support rib (bearing member) 422*b*. The first and second support ribs 422*a* and 422*b* contact the supporting member 430, so that they support the elastic member 420.

The first and second support ribs 422*a* and 422*b* do not overlap the first and second engaging portions 414 and 418 from the view of the pushing direction of button 410. In other words, the distance b between the center of the axle of the first button shaft 413*a* and the inner surface of the first engaging portion 414 is greater than the distance a between the center of the axle of the first button shaft 413*a* and the outer surface of the first support rib 422*a*. The distance b between the center of the axle of the second button shaft 413*b* and the inner surface of the second engaging portion 418 is longer than the distance a between the center of the axle of the second button shaft 413*b* and the outer surface of the second support rib 422*b*.

The corners of the first and second engaging portions 414 and 418 and the first and second support ribs 422*a* and 422*b*, which contact the elastic member 420, are chamfered. This chamfering reduces the reaction force against the pushing force, because the deformation volume of the elastic member 420 around the first and second engaging portions 414 and 418 and the first and second support ribs 422*a* and 422*b* is reduced when the button 410 is pushed down. Moreover, the operating life of the elastic member 420 is improved because the elastic member 420 does not deform more than required.

The operating device 400 is described below for the case that the button 410 is pushed down. As the swinging end near the first engaging portion 414 in the button 410 is pushed down, the button 410 swings on the fulcrum member 416. The first engaging portion 414 pushes the elastic member 320. The pushed elastic member 420 is deformed, thereby generating a reaction force on the button 410. The first button shaft 413*a* pushes the push switch 440. The portion of the elastic member 420 located around the first convex member 424*a* is stretched by the first button shaft 413*a*. A the button 410 is released, the first button shaft 413*a* is returned from the push switch 440*a* by the reaction force of the elastic member 420 to its original position.

According to the embodiment, the button 410 does not wobble, and the reaction force against the pushing force is reduced, resulting in an operating device, i.e. a rocker switch, with good tactile feedback during operation.

Figure 9:
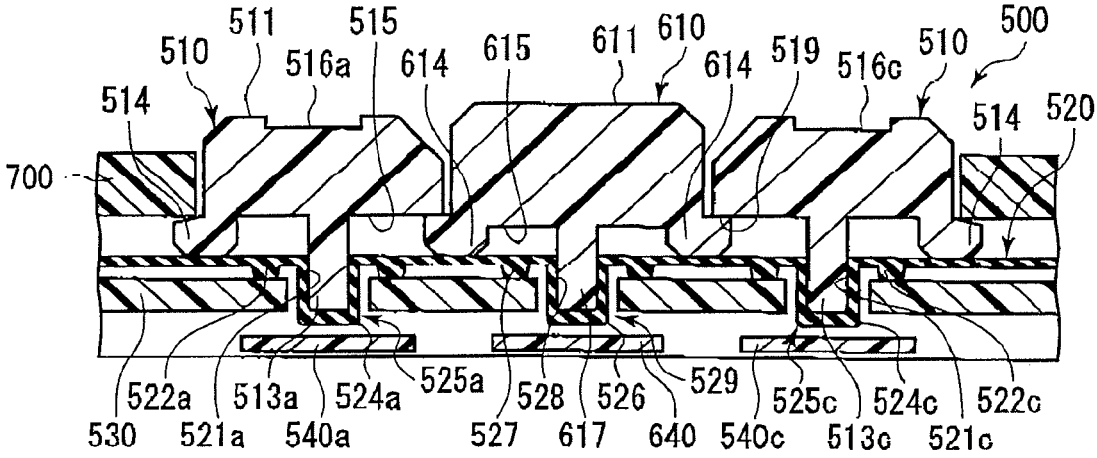
FIG. 9 is a cross-sectional view showing the operating device along the VIII-VIII line of FIG. 1 in another embodiment of the present invention.
Figure 10:
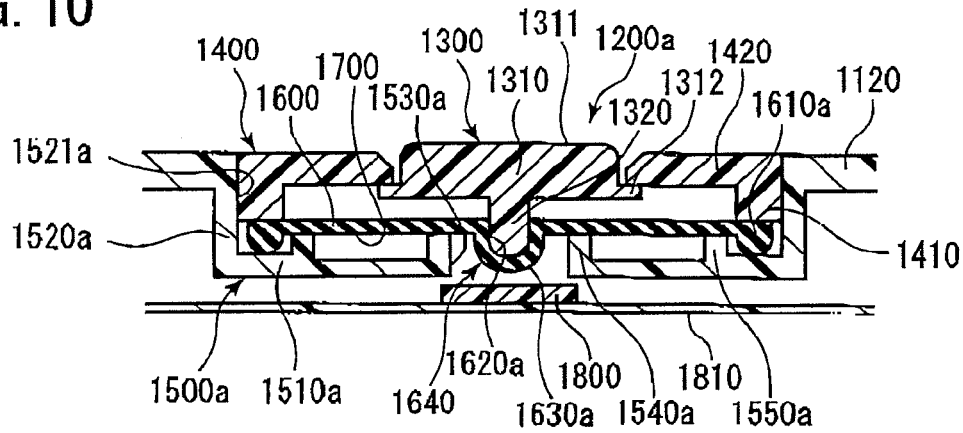
FIG. 10 is a cross-sectional view along the X-X line of FIG. 1 showing the waterproof operating device.
Figure 11:
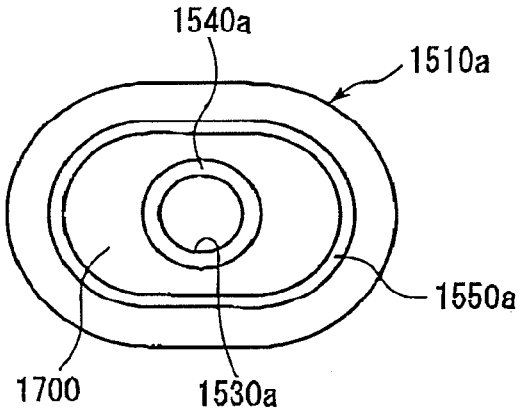
FIG. 11 is a bottom view showing a bearing member.

The fourth embodiment of the operating device is described below with reference to FIGS. 1 and 9. Descriptions of constructions similar to those of the first embodiment are omitted.

The operating device 500 comprises the first button 510 and the second button 610. The first button 510 exposes the toroidal-shaped first top surface 511 to the exterior of the camera 100. The second button 610 exposes the circle-shaped second top surface 611 from the center hole of the first top surface 511 to the exterior of the camera 100.

The first to fourth engraved marks 516*a*, 516*b*, 516*c*, and 516*d* are engraved so as to be equally spaced along the circumference of the first top surface 511. The first to fourth button shafts 513*a*, 513*b*, 513*c*, and 513*d* are provided on the back side of the first top surface 511 and on the positions corresponding respectively to the first to forth engraved marks 516*a*, 516*b*, 516*c*, and 516*d*. The second button 610 comprises the fifth button shaft 617 which projects from the center of the back side 615 of the first top surface 511. The operating device 500 is described below, referring to the cross-sectional view shown on the plane passing through the first and third button shaft axes. The description concerning the cross-sectional view shown on the plane passing through the second and forth button shaft axis is omitted because it is the same as the cross-sectional view shown on the plane passing through the first and third button shaft axis.

The elastic member 520 is attached to the bottom surface 515 of the first and second buttons 510 and 610. The bottom surface 515 is the back side of the top surface 511. The elastic member comprises the first, third, and fifth dent portions 521*a*, 521*a*, and 528 which engage respectively with the first, third, and fifth button shafts 513*a*, 513*c*, and 617. The elastic member comprises the first, third, and fifth dent portions 521*a*, 521*c*, and 528 projects from the back surface of the elastic member 520, so that they form the first, third, and fifth convex portions 524*a*, 524*c*, and 526. The back surfaces of the first, third, and fifth dent portions 521*a*, 521*c*, and 528 form the first, third, and fifth projecting portions 525*a*, 525*c*, and 529. The first, third, and fifth support ribs 522*a*, 522*c*, and 527 are provided around the first, third, and fifth convex portions 524*a*, 524*c*, and 526. The first, third, and fifth support ribs (bearing members) 522*a*, 522*c*, and 527 engage the supporting member 530, so as to support the elastic member 520.

The engaging portion 514 projects from the peripheral portion of the bottom surface 515 of the first button 510 to the elastic member 520. The engaging portion 514 projects from the circumference surface of the first button 510, so that it forms a flange. The engaging portion 614 projects from the bottom surface 615 of the second button 610 to the elastic member 520. The engaging portion 614 projects from the circumference surface of the second button 610, so that it forms a flange. The peripheral portion of the bottom surface of the first button 510 engages the flange of the second button 610. The circumference surface of the second button 610 is loosely fitted with the inner surface of the first button 510.

The first convex portion 524*a* is surrounded by the first support rib 522*a*. Similarly, the third and fifth convex portions 524*c*, and 526*a* are surrounded by the third and fifth support ribs 522*c*, and 527, respectively.

The operating device 500 is described below for the case that the first button 510 is pushed down. As the first engraved mark of the first button 510 is pushed down, the engaging portion 514 pushes the elastic member 520. The pushed elastic member 520 is deformed, so that it applies a reaction force to the first button 510. The first button shaft 513*a* pushes the push switch 540*a*. The portion of the elastic member 520 located around the first dent portion 521*a* is stretched by the first button shaft 513*a*. As the first button 510 is released, the first button shaft 513*a* is returned from the first push switch 540*a* to its original position by the reaction force of the elastic member 520.

As the second button 610 is pushed down, the first button does not move, the engaging portion 614 which is provided in the second button 610 is pushed against the elastic member 520. At this time, the engaging portion 614 pushes the outer portion of the elastic member 520 rather than the second support rib 527. The fifth button shaft 617 is pushed down together with the elastic member 520 towards the fifth push switch 640, so that it pushes on the fifth push switch 640.

According to the embodiment, the buttons 510 and 610 do not wobble, and the reaction force against the pushing force is reduced, resulting in an operating device with good tactile response during operation.

Note that the chamfers formed in engaging portions and supporting ribs may not be formed of straight lines in the cross-sectional plane, but must be formed by curved lines.

The fifth embodiment of the operating device is described below with reference to FIGS. 1, and 10 to 12. Descriptions concerning constructions similar to those of the first embodiment are omitted.

The waterproof operating device 1200*a* is mounted on top of the waterproof camera 1100 with the holding member 1400, and operated to execute a shutter release operation. The holding member 1400 comprises the hole 1401 at its center. The hole 1401 has a rounded rectangular shape, and its narrow side is formed into a circular arc. The top surface 1331 of the waterproof operating device 1200*a* protrudes through the hole 1401 to the exterior of the camera 1100. The user takes photographs by pushing the top surface 1311.

The waterproof operating device 1200*a* comprises the button 1300 exposed to the exterior of the camera 1100, the elastic member 1600*a* which prevents water from intruding into the camera 1100, and the supporting member 1500*a* which supports the elastic member 1600*a*.

The button 1300 comprises the pushing portion 1310 having the top surface 1311, and the shaft 1320 which projects from the center portion of the back surface of the top surface 1311 to the inside of the waterproof camera 1100. The pushing portion 1310 has a rounded rectangular shape with thickness. The flange 1312 is formed around the rounded rectangular shape and near the bottom surface. The bottom surface is the back side of the top surface of the pushing portion 1310. The lateral surface of the pushing surface 1310 freely engages the inner surface of the hole 1401, so that the position of the top surface 1311 is set in consideration of the holding member 1400. The flange 1312 engages the edge of the hole 1401, so that the protrusion length of the pushing portion 1311 from the holding member 1400 is limited.

The elastic member 1600*a* has a rounded rectangular shape with thickness. The water-stopping rib 1610*a* is formed around the rounded rectangular shape. The water-stopping rib 1610*a* is engaged around the circumference of the bottom portion 1510*a*. The projecting portion 1640 is formed in the center of the elastic member 1600*a*. The projecting portion 1640 covers the end of the shaft 1320 and is elastically deformed by pressure form the shaft 1320. The dent portion 1620*a* is formed on the top surface of the elastic member 1600*a* for engaging the shaft 1320. The top surface faces the button 1300. The convex portion 1630*a* projects parallel to the projecting direction of the water-stopping rib 1610*a*, i.e. downward in FIG. 12, from the surface facing the supporting member 1500*a*, i.e., the back surface of the dent portion 1620*a* of the projecting portion 1640.

The supporting member 1500*a* has a bottom portion 1510*a* and lateral portion 1520*a* which is perpendicular to the exterior surface of the waterproof camera, i.e., it has a cylindrical shape with a bottom. The opening 1530*a* is provided in the center of the bottom portion 1510*a*, and freely engages with the convex portion 1630*a*, so that the convex portion 1630*a* moves freely along with the axis of the shaft 1320. The first rib 1540*a* projects from the surface of the bottom portion 1510*a* which faces the elastic member 1600*a*, and surrounds the convex portion 1630*a*.

The water-stopping rib 1610*a* contacts the circumference of the bottom portion 1510*a* of the supporting member 1500*a*. The supporting member 1500*a* comprises the first rib 1540*a* which projects toward the elastic member 1600*a* from the circumference of the opening 1530*a* and the second rib 1550*a* which project toward the elastic member 1600*a* from the outside of the first rib 1540*a*. The first rib 1540*a* contacts the circumference of the convex portion 1630*a* of the elastic member 1600*a*. The second rib 1550*a* contacts the inner surface of the water-stopping rib 1610*a*. The water-stopping rib 1610*a* and the supporting member 1500*a* are bonded together by ultrasonic welding or by adhesive. The first and the second ribs 1540*a*, 1550*a* and the elastic member 1600*a* are not bonded.

The first rib 1540*a* and the second rib 1550*a* are provided in the supporting member 1500*a* so that the area enclosed by the first rib 1540*a* and the second rib 1550*a* is larger than the area enclosed by the first rib 1540*a*. The chamber 1700 is toroidal and provided between the elastic member 1600*a*, the supporting member 1500*a*, the first rib 1540*a*, and the second rib 1550*a*.

The holding member 1400 comprises the fixing portion 1410 which engages the whole circumference of the inner surface 1521*a*, and the engaging portion 1420 which extends from the end of the fixing portion 1410 to the button 1300. The fixing portion 1410 clamps the water-stopping rib 1610*a* onto the bottom portion 1510*a*. The engaging portion 1420 extends from the end which clamps the water-stopping rib 1610*a*, to the button 1300, and engages the flange 1312, so that the button 1300 is fastened to the waterproof camera 1100. The water-stopping rib 1610*a* is pinched between the holding member 1400 and the supporting member 1500*a*.

Therefore, the invention prevents water from penetrating into the waterproof camera 1100. In addition, the second rib 1550*a* is surrounded by the fixing portion 1410, so that the area surrounded by the second rib 1550*a* does not contact the bottom portion of the holding member 1400, and is not affected by the holding force of the holding member 1400.

The substrate 1810 is provided under the supporting member 1500*a*. The push switch 1800 is soldered on the substrate 1810, so that it faces the convex portion 1630*a*.

When the pushing portion 1310 is depressed by the user, the shaft 1320 which engages the dent portion 1620*a* is pushed down, so that the shaft 1320 pushes down the push switch 1800. When the push switch 1800 is pushed down, it sends signals to the digital signal processor provided in the waterproof camera 1100. The digital signal processor receives the signals, and executes the photographing operation.

When the shaft 1320 is pushed down, the dent portion 1620*a* is pushed down, thereby the portion of the elastic member 1600*a* around the opening 1530*a* is stretched by the shaft 1320. The reaction force applied by the stretched elastic member 1600*a* to the shaft 1320 is transmitted to the user through the pushing portion 1310, to give tactile feedback. Properly controlling the elastic force of the elastic member 1600*a* will give the user an appropriate tactile response.

Figure 12:
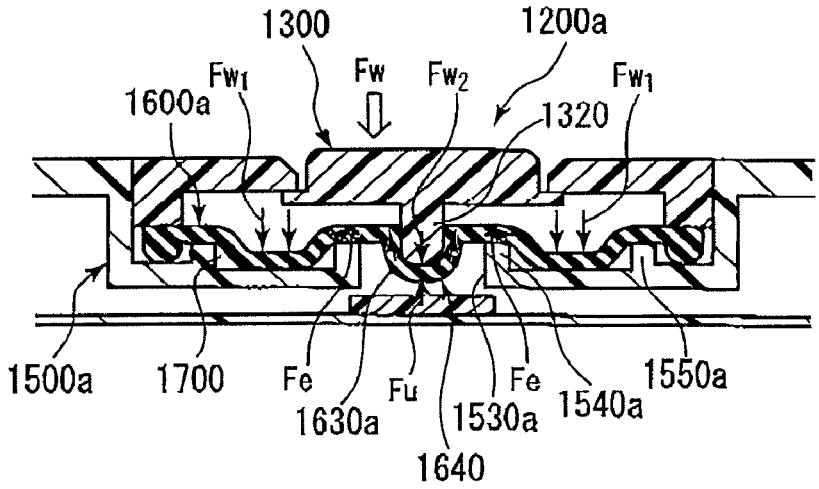
FIG. 12 is a cross-sectional view along the X-X line of FIG. 1 showing the waterproof operating device under water pressure.

Movement of the waterproof operating device 1200*a* under water is described below with reference to FIG. 12.

When water pressure Fw is applied to the waterproof operating device 1200*a*, water penetrates between the button 1300 and the elastic member 1600*a*, so that water pressure Fw is applied to the elastic member 1600*a*.

Water pressure Fw which is applied to the button 1300 and the portion surrounded by the first rib 1540*a* pushes down the convex portion 1630*a* of the elastic member 1600*a* toward the push switch 1800.

Water pressure Fw which is applied to the portion of the elastic member 1600*a* located between the first rib 1540*a* and the second rib 1550*a* pushes down the portion of the elastic member 1600*a* toward the supporting member 1500*a*. That portion of the elastic member 1600*a* stretches the portion of the elastic member 1600*a* located inside the first rib 1540*a*, in the direction of the first rib 1540*a*. The stretched elastic member 1600*a* increases in tension, so that it pushes up the shaft 1320 toward the exterior of the waterproof camera 1100.

The upward force Fu counters the water power Fw2. The water pressure Fw2 is applied to the portion of the elastic member 1600*a* which is located inside the first rib 1540*a* and covers the opening 1530*a*. The area of the elastic member 1600*a* enclosed by the first rib 1540*a* and the second rib 1550*a* is larger than the area of the elastic member 1600*a* enclosed by the first rib 1540*a*. Therefore, the water pressure Fw1 applied to the area, of the elastic member 1600*a* enclosed by the first rib 1540*a* and the second rib 1550*a* is larger than the water pressure Fw2 applied to the area of the elastic member 1600*a* enclosed by the first rib 1540*a*. That is, the stretching force which stretches the portion of the elastic member 1600*a* enclosed by the first rib 1540*a* toward the first rib 1540*a* is larger than the water pressure Fw2.

When the water pressure Fw is applied to the elastic member 1600*a*, the convex portion 1630*a* does not contact the push switch 1800, so that the push switch 1800 is not pressed. In addition, the elastic force which counters the water pressure is applied to the button 1330, making the operating force of the waterproof operating device 1200*a* under atmospheric pressure approximately equal to the force under water.

Figure 13:
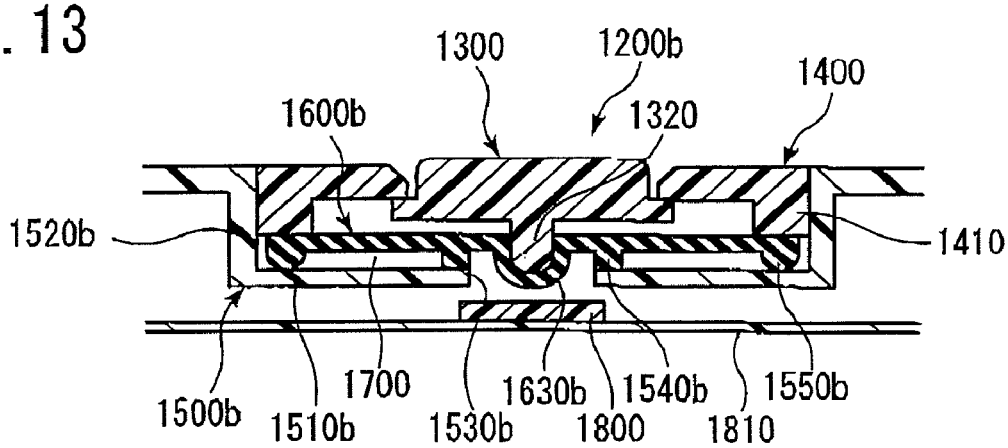
FIG. 13 is a cross-sectional view showing a waterproof camera having a waterproof operating device in another embodiment of the present invention.
Figure 14:
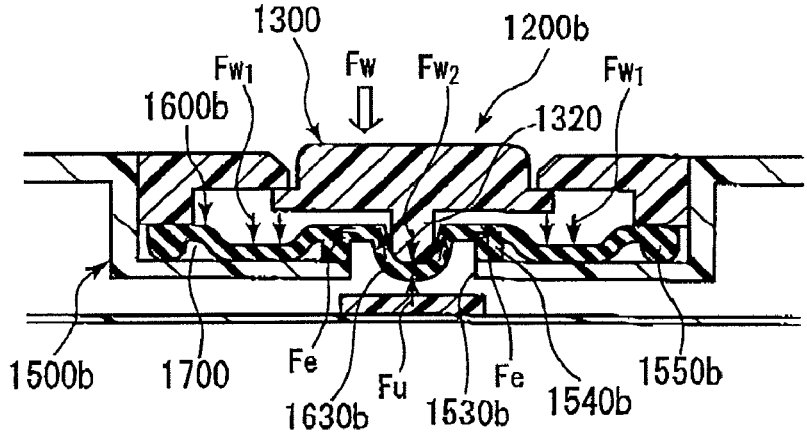
FIG. 14 is a cross-sectional view showing the waterproof operating device under water pressure.

The sixth embodiment of the operating device is described below with reference to FIGS. 13 and 14. Descriptions of constructions similar to those of the first embodiment are omitted.

In this embodiment, the first rib 1540*b* and the second rib 1550*b* which forms the chamber 1700 are provided in the elastic member 1600*b*, instead of the supporting member 1500*a*, and the second rib 1550*b* combine with the water-stopping rib.

The second rib 1550*b* projects from the outer edge of the bottom surface of the elastic member 1600*b*. The bottom surface faces the supporting member 1500*b*. The first rib 1540*b* is toroidal-shaped, and projects from the perimeter of the convex portion 1630*b* on the bottom surface of the elastic member 1500*b*. The first rib 1540*b* and the second rib 1550*b* are provided on the elastic member 1600*b*, so that the area of the elastic member 1600*a* enclosed by the first rib 1540*b* and the second rib 1550*b* is larger than the area of the elastic member 1600*a* enclosed by the first rib 1540*b*.

The second rib 1550*b* contacts the circumference of the bottom portion 1510*b* of the supporting member 1500*b*. The first rib 1540*b* contacts the perimeter of the opening 1530*b* of the supporting member 1500*b*. The first rib 1540*b* and the second rib 1550*b* are bonded to the supporting member 1500*b* by ultrasonic or adhesive. The toroidal-shaped chamber 1700 is formed between the elastic member 1600*b*, the supporting member 1500*b*, the first rib 1540*b*, and the second rib 1550*b*.

The fixing portion 1410 of the holding member 1400 clamps the second rib 1550*b* toward its thickness direction. The elastic member 1600*b* is attached firmly to the supporting member 1500*b*, prevents water from penetrating into the inside of the waterproof camera 1100.

Movement of the waterproof operating device 1200*b* under water is described below with FIG. 14.

When water pressure Fw is applied to the waterproof operating device 1200*b*, water penetrates between the button 1300 and the elastic member 1600*b*, so that the water pressure Fw is applied to the elastic member 1600*b*.

Water pressure Fw which is applied to the button 1300 and the portion surrounded by the first rib 1540*b* pushes down the convex portion 1630*b* of the elastic member 1600*b* toward the push switch 1800.

Water pressure Fw which is applied to the portion of the elastic member 1600*b* located between the first rib 1540*b* and the second rib 1550*b* pushes down the portion of the elastic member 1600*b* toward the supporting member 1500*a*. The portion of the elastic member 1600*b* stretches the portion of the elastic member 1600*b* located inside of the first rib 1540*b* toward the first rib 1540*b*. The stretched elastic member 1600*b* increases its tension, so that it pushes up the shaft 1320 toward the exterior of the waterproof camera 1100.

The pushing up power Fu counters the water power Fw2. The water power Fw2 is applied to the portion of the elastic member 1600*b* which is located inside of the first rib 1540*b* and covers the opening 1530*b*. The area of the elastic member 1600*b* enclosed by the first rib 1540*b* and the second rib 1550*b* is larger than the area of the elastic member 1600*b* enclosed by the first rib 1540*b*. Therefore, the water pressure Fw1 applied to the area of the elastic member 1600*b* enclosed by the first rib 1540*b* and the second rib 1550*b* is larger than the water pressure Fw2 applied to the area of the elastic member 1600*b* enclosed by the first rib 1540*b*. That is, the stretching force which stretches the portion of the elastic member 1600*b* enclosed by the first rib 1540*b* toward the first rib 1540*b* is larger than the water pressure Fw2.

According to this embodiment, ribs are provided on the elastic member 1600*b*. Therefore, the shape of the supporting member 1500*b* is simplified, so that the supporting member 1500*b* is easily formed.

Note that, the waterproof operating devices 1200*b* may not be used as a shutter release, but may be used as other operating devices provided in the waterproof camera 1100.

According to the embodiment, other operating devices have good tactile response under atmospheric pressure and under water, and prevent the water force Fw from pushing the buttons of the other operating devices.

Although the embodiment of the present invention has been described herein with reference to the accompanying drawings, obviously many modifications and changes may be made by those skilled in the art without departing from the scope of the invention.

The present disclosure relates to subject matter contained in Japanese Patent Application Nos. 2007-173808 (filed on Jul. 2, 2007) and 2007-174414 (filed on Jul. 2, 2007), which are expressly incorporated herein, by reference, in their entirety.

What is claimed is:

1. An operating device comprising:

a supporting member that has an opening which passes through a thickness direction of said supporting member;

a button that has a shaft and an engaging portion, said shaft being arranged such that an axial direction of the shaft is parallel to the thickness direction of said supporting member, said engaging portion projecting parallel to the axial direction of the shaft;

an elastic member that is set onto said supporting member so as to cover the opening, and has a projecting portion which engages an end of the shaft; and a bearing member that is provided between said supporting member and said elastic member, which is provided around the opening and is located nearer to the shaft than the engaging portion in a direction orthogonal to the axial direction of the shaft, wherein the shaft is configured to press said elastic member so that said elastic member is deformed so as to move along the thickness direction of said supporting member in the opening.

2. The operating device according to claim 1 further comprising a push switch that faces the end of the shaft, wherein the shaft covered by the projecting portion projects from an inner side of the opening, and pushes said push switch, when said button is pushed.

3. The operating device according to claim 1, wherein the engaging portion has a corner which contacts said elastic member, and said corner is chamfered.

4. The operating device according to claim 1, wherein said bearing member is provided in said elastic member.

5. The operating device according to claim 4, wherein said bearing member has a corner which contacts said supporting member, and said corner is chamfered.

6. The operating device according to claim 1, wherein said bearing member is provided in said supporting member.

7. The operating device according to claim 6, wherein said bearing member has a corner which contacts said elastic member, and said corner is chamfered.

8. The operating device according to claim 1, wherein said button comprises a fulcrum portion which projects parallel to the axial direction of the shaft, said elastic member comprises a projecting fulcrum portion which covers the fulcrum portion, said the projecting fulcrum portion contacts said supporting member, said button pivotally engages the projecting fulcrum portion, the engaging portion being provided in proximity of pivoting ends of the button, and the shaft is nearer to the fulcrum portion than the engaging portion in the direction orthogonal to the axial direction of the shaft.

9. The operating device according to the claim 1, wherein said button comprises:

a first button member that has a pushed portion which is generally cylindrical, engaging portions which project from the pushed portion in parallel to the axial direction of the pushed portion, and a projecting portion which projects in the radial direction of the pushed portion from the engaging portion; and a second button member that is generally cylindrical, has shafts which project in the axial direction of the second button member and an inner surface which freely fits a lateral surface of the pushed portion, wherein an end of the inner surface engages the projecting portion.

10. The operating device according to claim 9, wherein said elastic member, said supporting member, and said bearing member form an air chamber, and the air chamber is configured to be crushed by a pushing of said engaging portion.

11. A waterproof operating device comprising:

a button that has a shaft;

a supporting member that has an opening which passes through a thickness direction of the supporting member;

an elastic member that is set onto said supporting member so as to cover the opening, and has a projecting portion which engages an end of the shaft;

a first rib that is provided around the opening between said supporting member and said elastic member; and a second rib that is provided around said first rib between said supporting member and said elastic member, said first rib and said second rib forming a chamber between them, the chamber being provided around the opening, and a cross-sectional area of the chamber being larger than a cross-sectional area of the opening in a direction orthogonal to a projecting direction of the shaft, wherein the shaft is configured to press said elastic member so that said elastic member is deformed so as to move along the thickness direction of said supporting member in the opening.

12. The waterproof operating device according to claim 11 further comprising a push switch that faces the shaft, wherein the shaft projects from the opening, and pushes said push switch when said button is pushed.

13. The waterproof operating device according to the claim 11, wherein said first rib is provided in said elastic member.

14. The waterproof operating device according to the claim 11, wherein said second rib is provided in said elastic member.

15. The waterproof operating device according to the claim 11, wherein said first rib is provided in said supporting member.

16. The waterproof operating device according to the claim 11, wherein said second rib is provided in said supporting member.

17. The waterproof operating device according to claim 11, wherein said first rib, said second rib, and said elastic member form an air chamber, and the air chamber is configured to be crushed by a pressure from outside of the waterproof operating device.

* * * * *